US010392873B2

(12) United States Patent
Kandaswami et al.

(10) Patent No.: US 10,392,873 B2
(45) Date of Patent: Aug. 27, 2019

(54) SELECTIVE SEAL STEM ANCHOR

(71) Applicant: SCHLUMBERGER TECHNOLOGY CORPORATION, Sugar Land, TX (US)

(72) Inventors: Aravind Kandaswami, Humble, TX (US); Sebastian Calo, Conroe, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 15/709,105

(22) Filed: Sep. 19, 2017

(65) Prior Publication Data

US 2018/0135358 A1 May 17, 2018

Related U.S. Application Data

(60) Provisional application No. 62/396,801, filed on Sep. 19, 2016.

(51) Int. Cl.

| | |
|---|---|
| ***E21B 23/01*** | (2006.01) |
| ***E21B 17/06*** | (2006.01) |
| ***E21B 43/10*** | (2006.01) |
| ***E21B 23/02*** | (2006.01) |

(52) U.S. Cl.

CPC ..... *E21B 17/06* (2013.01); *E21B 23/01* (2013.01); *E21B 23/02* (2013.01); *E21B 43/10* (2013.01)

(58) Field of Classification Search

CPC .... E21B 23/01; E21B 33/129; E21B 33/1291; E21B 33/1292; E21B 33/1293

See application file for complete search history.

(56) References Cited

U.S. PATENT DOCUMENTS

| | | | | |
|---|---|---|---|---|
| 4,391,326 A | | 7/1983 | Greenlee | |
| 4,513,822 A | | 4/1985 | Gilbert | |
| 5,423,382 A | * | 6/1995 | Barton | E21B 23/01 166/297 |
| 2007/0051521 A1 | * | 3/2007 | Fike | E21B 23/06 166/387 |

* cited by examiner

*Primary Examiner* — Giovanna C Wright

(57) ABSTRACT

A seal stem anchor assembly of the present disclosure includes: a tubular portion having body lock threads disposed about an external portion; and an anchor assembly including an activation module about the tubular portion and proximate the body lock threads, a cone, one or more anchor slips extending between the activation module and the cone, and a helical spring positioned and biased so as to push the activation module away from the cone.

6 Claims, 6 Drawing Sheets

SELECTIVE SEAL STEM ANCHOR

CROSS-REFERENCE TO RELATED APPLICATIONS

The present application is related to and claims priority to U.S. Provisional Patent Application No. 62/396,801, filed Sep. 19, 2016, which is incorporated by reference herein.

BACKGROUND

This section provides background information to facilitate a better understanding of the various aspects of the disclosure. It should be understood that the statements in this section of the document are to be read in this light, and not as admissions of prior art.

Liner hangers are used to hang liners in a casing. Liner hangers normally accompany a liner top packer and tie back receptacle ("TBR"). The liner top packer creates a barrier in the casing-liner annulus. The tie back receptacle provides a way to tie back the production liner to the top of the well with a seal stem. The seal stem is normally allowed to float in the inner diameter ("ID") of the TBR.

SUMMARY

In general, a seal stem anchor assembly of the present disclosure includes: a tubular portion having body lock threads disposed about an external portion; and an anchor assembly including an activation module about the tubular portion and proximate the body lock threads, a cone, one or more anchor slips extending between the activation module and the cone, and a helical spring positioned and biased so as to push the activation module away from the cone.

This summary is provided to introduce a selection of concepts that are further described below in the detailed description. Many modifications are possible without materially departing from the teachings of this disclosure. Such modifications are intended to be included within the scope of this disclosure as defined in the claims. Accordingly, this summary is not intended to identify key or essential features of the claimed subject matter, nor is it intended to be used as an aid in limiting the scope of the claimed subject matter.

BRIEF DESCRIPTION OF THE FIGURES

Certain embodiments of the disclosure will hereafter be described with reference to the accompanying drawings, wherein like reference numerals denote like elements. It is emphasized that, in accordance with standard practice in the industry, various features are not drawn to scale. In fact, the dimensions of various features may be arbitrarily increased or reduced for clarity of discussion. It should be understood, however, that the accompanying figures illustrate the various implementations described herein and are not meant to limit the scope of various technologies described herein, and.

DETAILED DESCRIPTION

Figure 1:
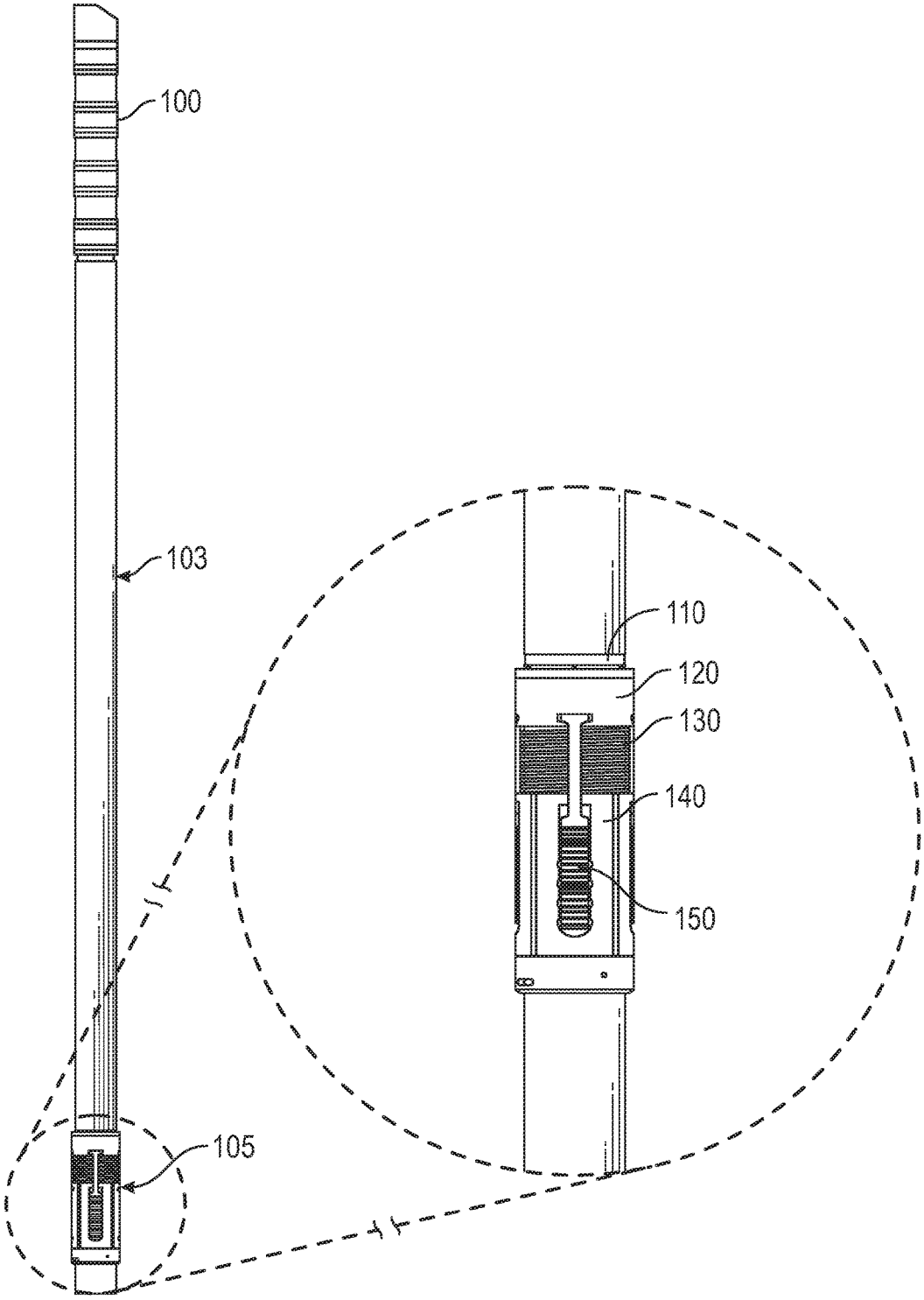
FIG. 1 is an illustration of an example seal stem, according to an embodiment of the disclosure.

In the following description, numerous details are set forth to provide an understanding of some embodiments of the present disclosure. It is to be understood that the following disclosure provides many different embodiments, or examples, for implementing different features of various embodiments. Specific examples of components and arrangements are described below to simplify the disclosure. These are, of course, merely examples and are not intended to be limiting. In addition, the disclosure may repeat reference numerals and/or letters in the various examples. This repetition is for the purpose of simplicity and clarity and does not in itself dictate a relationship between the various embodiments and/or configurations discussed. However, it will be understood by those of ordinary skill in the art that the system and/or methodology may be practiced without these details and that numerous variations or modifications from the described embodiments are possible. This description is not to be taken in a limiting sense, but rather made merely for the purpose of describing general principles of the implementations. The scope of the described implementations should be ascertained with reference to the issued claims.

As used herein, the terms "connect", "connection", "connected", "in connection with", and "connecting" are used to mean "in direct connection with" or "in connection with via one or more elements"; and the term "set" is used to mean "one element" or "more than one element". Further, the terms "couple", "coupling", "coupled", "coupled together", and "coupled with" are used to mean "directly coupled together" or "coupled together via one or more elements". As used herein, the terms "up" and "down"; "upper" and "lower"; "top" and "bottom"; and other like terms indicating relative positions to a given point or element are utilized to more clearly describe some elements. Commonly, these terms relate to a reference point at the surface from which drilling operations are initiated as being the top point and the total depth being the lowest point, wherein the well (e.g., wellbore, borehole) is vertical, horizontal or slanted relative to the surface.

The disclosure herein generally involves a system for selectively anchoring a seal stem such that the integrity of the TBR is not compromised. More specifically, the present disclosure provides a system that can anchor and carry a heavy load, but also can slide up and down to accommodate changes in length of the tubing due to temperature fluctuation without placing a load on the TBR.

A system of the present disclosure may include a pocket slip anchor assembly disposed on the top of the seal stem below the stopper ring. The anchor may include an activation module assembly which selectively pushes the slip(s) out. In some embodiments of the disclosure, the seal stem anchor deploys when the activation module assembly shoulders against the top of the TBR. The seal stem may float inside the TBR when not deployed.

An activation module assembly according to an embodiment of the disclosure may include one or more sets of the following components: a locking member such as a lock lug, a disengagement member such as a push pin, and a biasing member such as a C-spring, or other suitable biasing member. The number of sets may be varied based on the expected loads while tripping downhole. For example, in some embodiments, there may be six sets. In other embodiments, there may be more sets if a larger load is expected or fewer sets if a lower load is expected.

The activation module assembly may be disposed within a pocket of the activation module housing. The slip arms of the anchor are assembled in the housing. The body has lock ring threads that hold the lock lug(s), housing, and anchor in place. The lock lugs interact with the lock ring threads on the body preventing the anchor from presetting while tripping downhole. The C-spring forces the lock lugs against the lock rings, preventing preset until the activation module housing butts against the top of the TBR.

Activation of the system may occur when all of the push pins, and in turn the activation module housing, butts against the top of the TBR. When this occurs, the push pins are activated/loaded, which in turn pushes on the wedge on the lock ring moving it up and away from the lock ring threads. When the lock lugs are no longer in contact with the lock ring on the body, axial movement of the housing may occur causing the slips to set the anchor and transferring load to the casing.

In some embodiments of the disclosure, activation can only occur if all of the push pins are loaded and pushed inside the activation module housing by the TBR. In such embodiments, if, while tripping downhole, one of six of the push pins (in a six set embodiment) becomes loaded and is pushed inside the activation module housing, only one of the six lock lugs will lose contact with the lock ring thread while the other five lock lugs will remain in contact.

After the activation module assemblies are activated and the activation module housing moves axially to set the anchor, a helical spring is compressed concomitantly storing energy. While anchoring, all the compressive load will be carried by the anchor slips and transferred to the casing resulting in no load on the TBR. The anchor cone shoulders against the shoulder ring, which may be put in place with the aid of lock wires or by false shoulder due to the large load carried by the component.

As discussed above, the seal stem may move away from the TBR top due to temperature fluctuations resulting in a release of the energy stored in the compressed spring. This results in pushing the slips back and unsetting the hanger allowing the seal stem to move freely. When the activation module housing butts against the TBR, the seal stem may again set itself. The setting, unsetting, and re-setting process may occur numerous times throughout the life of the well.

Referring generally to FIG. 1, a seal stem anchor assembly 100 according to an embodiment of the disclosure is presented. The seal stem anchor assembly 100 includes a tubular portion 103 having an anchor assembly 105 disposed on one end. The tubular portion 103 may include body lock threads 110. The anchor assembly includes activation module 120, helical spring 130, cone 140, and one or more anchor slips 150. A first end of each anchor slip engages the activation module 120 while the second end of each slip engages cone 140. The helical spring 130 extends between activation module 120 and cone 140.

Figure 2:
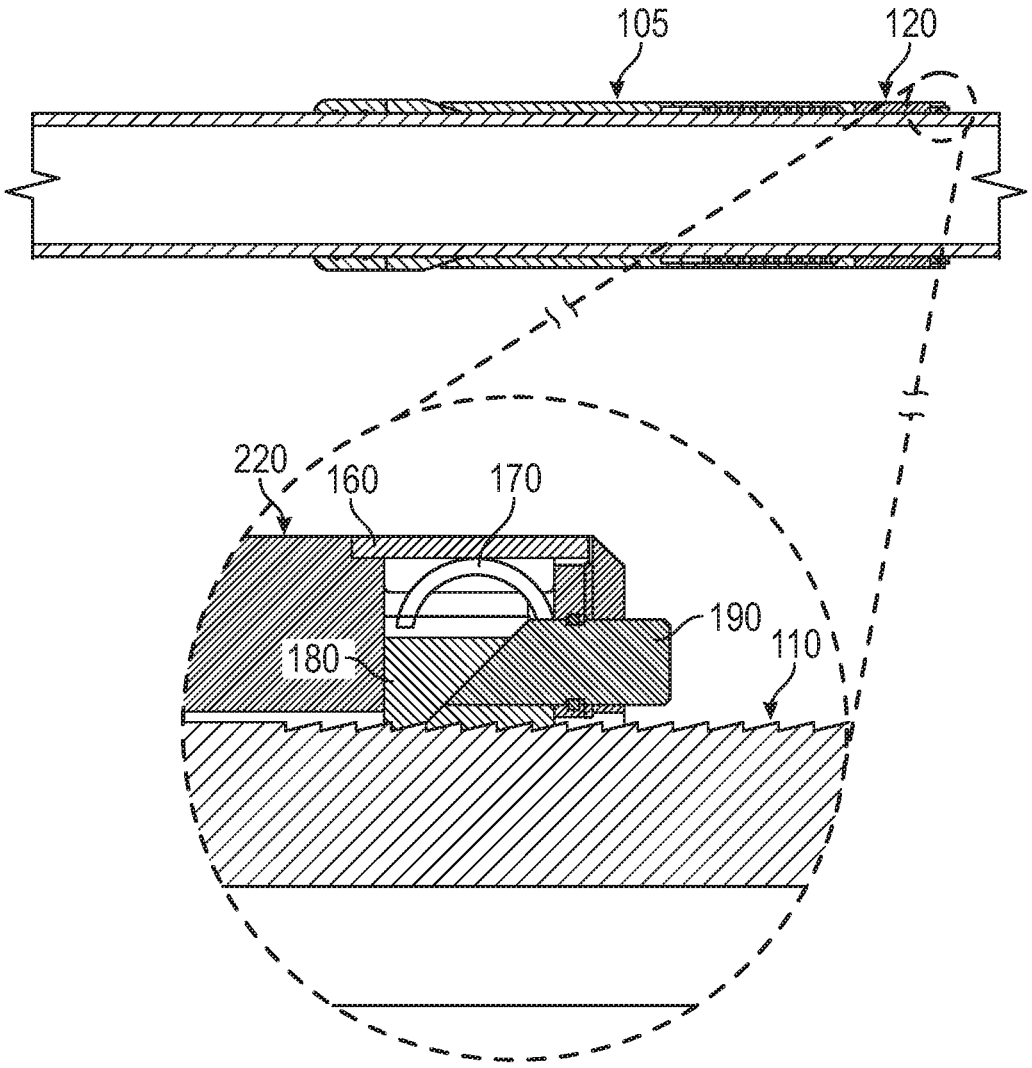
FIG. 2 is an illustration of a portion of an example activation module, according to an embodiment of the disclosure.

Referring generally to FIG. 2, a cross-section of activation module 120 of anchor assembly 105 is presented. Activation module 120 includes activation module housing 220, a cover 160 extending circumferentially around activation module housing 220, and one or more assemblies of C-spring 170, lock lug 180, and push pin 190, each disposed within a housing cavity. Each lock lug 180 is biased toward the lock threads 110 by a biasing member. For example, the lock lug may be pressed against body lock threads 110 by a C-spring 170. It should be appreciated that other forms of biasing members may be implemented, including, for example, elastomeric members, coil springs, and so forth. Push pin 190 extends upwardly from a ramped surface of a lock lug 180 through an opening in the upper surface of the activation module housing 220. Push pin includes an engagement surface which contacts the ramped surface of the lock lug 180.

As may be appreciated, the interaction between the push pin 190 and the lock lugs 180 engage and/or disengage the lock lugs with lock threads 110. As the push pin is moved towards the lock lugs longitudinally, the push pin urges the lock lugs radially outwardly to disengage the lock threads 110. As the push pin moves away from the lock lugs in a longitudinal direction, the C-spring 170 urges the lock lugs into engagement with the lock threads 110.

Figure 3:
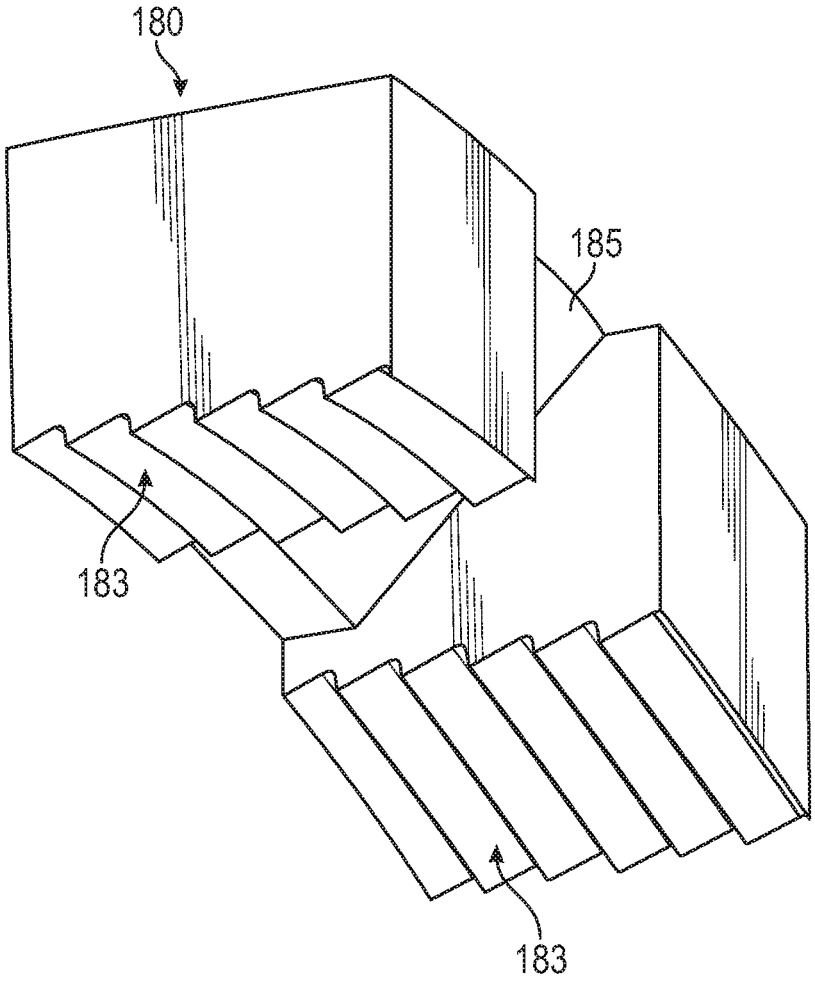
FIG. 3 is an illustration of an example lock lug, according to an embodiment of the disclosure.

Referring generally to FIG. 3, a lock lug 180 according to an embodiment of the disclosure is presented. The lock lug 180 includes a pair of lock lug teeth 183 disposed on surfaces to engage body lock threads 110. That is the lock lug teeth 183 are oriented on an inwardly facing surface of the lock lug 180 so that they may engage the body lock threads 110. The lock lug 180 also includes a ramped surface 185 that push pin 190 slides along to set and unset the lock lug, as discussed above. As shown, the ramped surface 185 and the angled surface of the push pin 190 correspond such that force may be translated along the length of the surface of the push pin to urge the lock lug outwardly as the push pin slides towards and under the lick lug.

Figure 4:
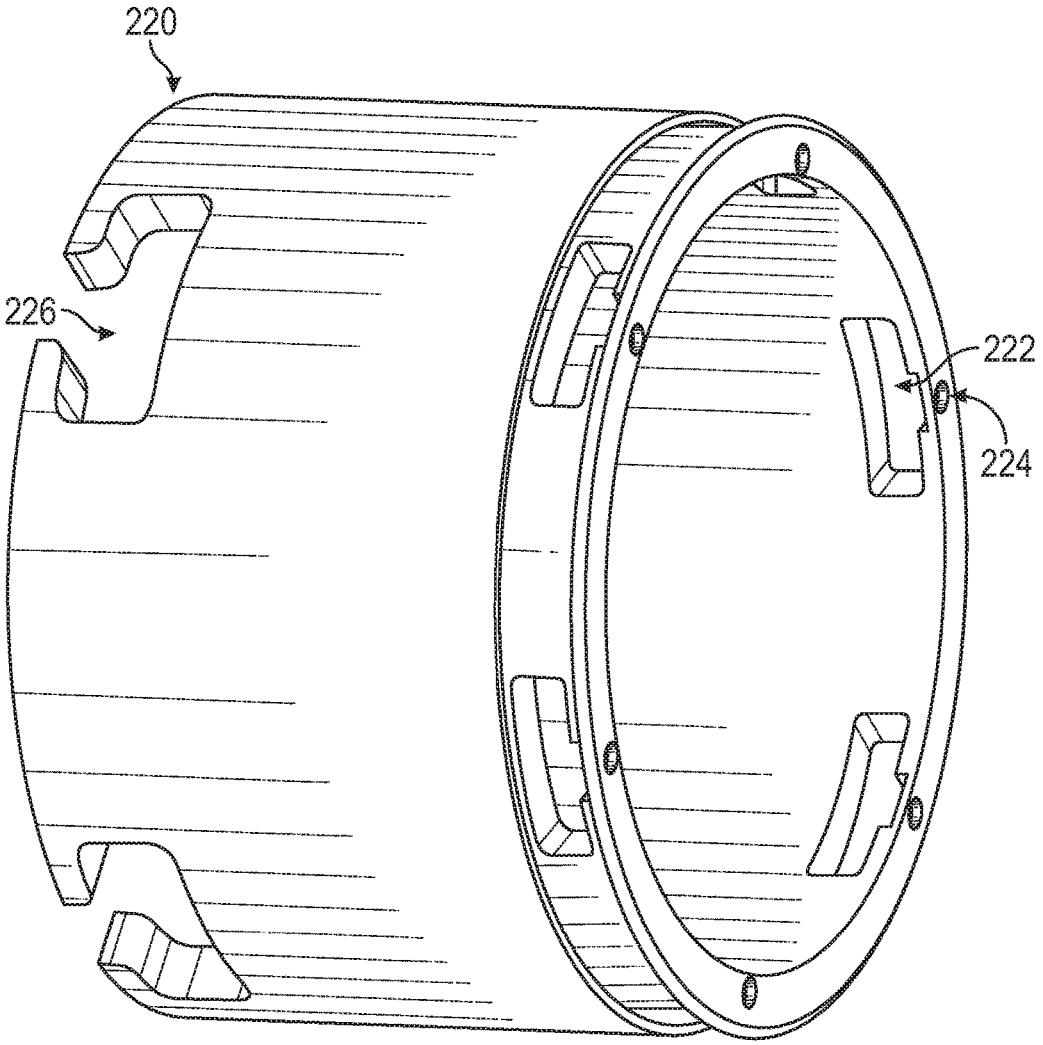
FIG. 4 is an illustration of an example activation module housing, according to an embodiment of the disclosure.

Referring generally to FIG. 4, an activation module housing 220 according to an embodiment of the disclosure is presented. The activation module housing 220 has a generally annular shape with a central bore 228. The activation module housing may be sized to fit around tubular portion 103. An upper end of the activation module housing 220 may include one or more housing cavities 222 and an associated opening 224. Each housing cavity 222 may include an assembly of a biasing member (e.g., C-spring 170), lock lug 180, and push pin 190, as previously described. Push pin 190 may extend upwardly through opening 224. A lower end of the activation module housing 220 may include one or more slip receiving features 226. Each slip receiving feature 226 may be configured to receive and secure one end of an anchor slip.

Figure 5:
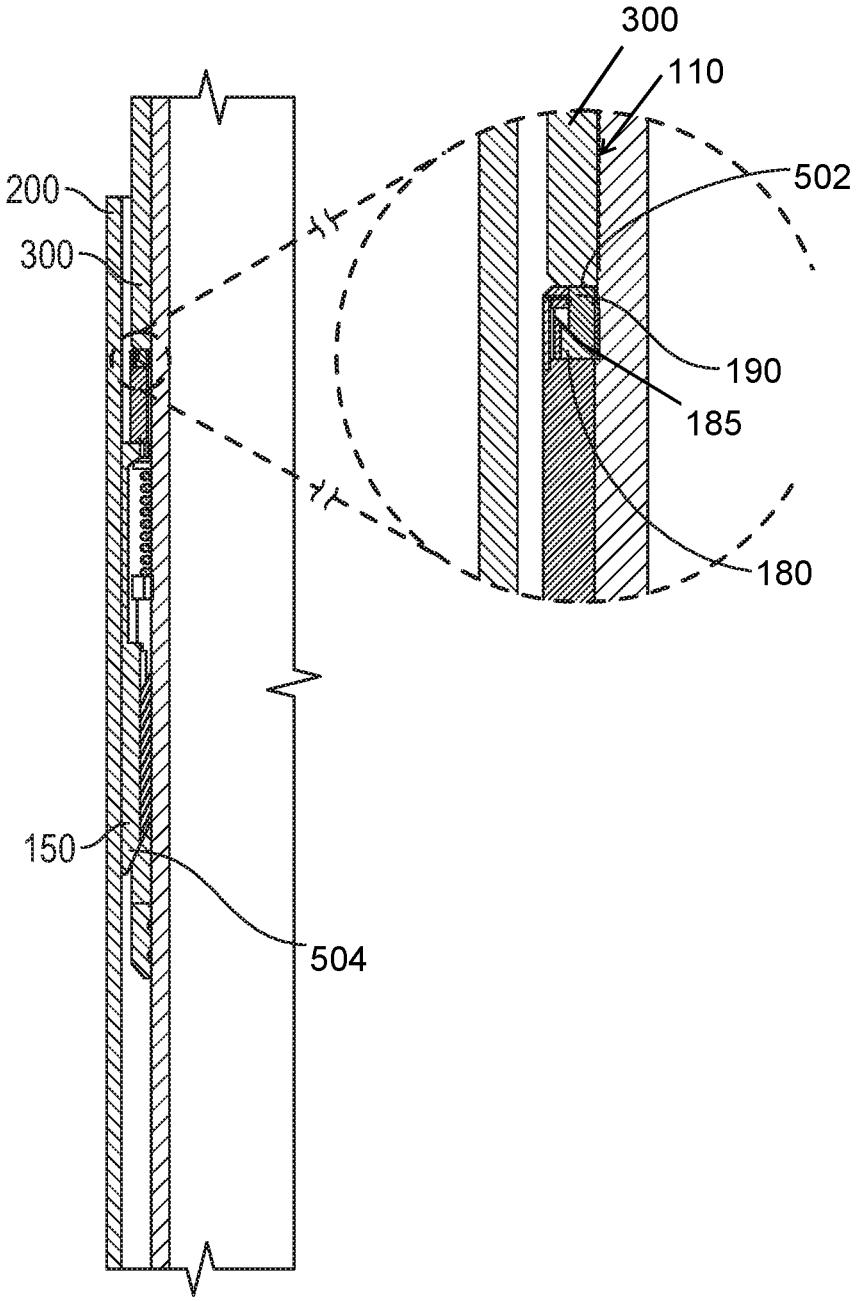
FIG. 5 is an illustration during setting of the seal stem, according to an embodiment of the disclosure.

Referring generally to FIG. 5, setting of the seal stem inside a casing 200 by butting against a TBR 300 is shown. As the upper surface 502 of the push pins 190 is butted against the top of the TBR 300, the push pins 190 press downwardly on the ramped surface 185 of each lock lug 180 causing the lock lug to withdraw from engagement with body lock threads 110. Once disengaged, the slips 150 can be set, as generally shown at 504, transferring the load to the casing and protecting the TBR from damage.

Figure 6:
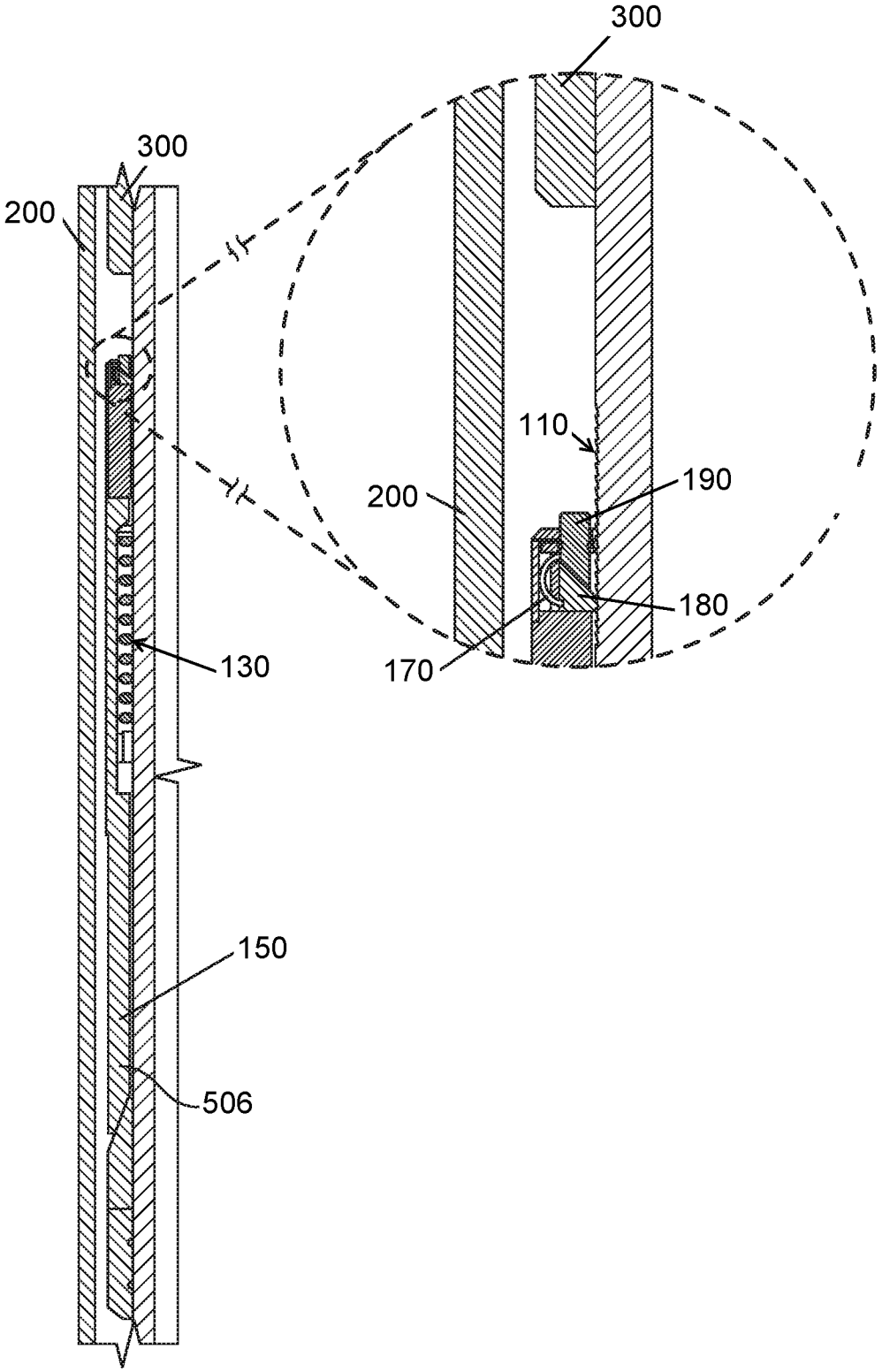
FIG. 6 is an illustration while moving away from the TBR, according to an embodiment of the disclosure.

Referring generally to FIG. 6, as temperature fluctuations cause the seal stem to move away from the TBR 300, the stored energy in the helical spring 130 will cause the anchor to unset, as shown generally at 506. The C-springs 170 in the activation module will cause the lock lugs 180 to contact the body lock threads 110 and force the push pins 190 upwardly to prevent preset during the next downward cycle.

In some embodiments of the disclosure, seal stem is constructed of $H_2S$ compatible materials. It should be appreciated, however, that the seal stem and other components may be constructed of any suitable and conventionally used material.

Embodiments disclosed herein may both anchor the seal stem to support heavy loads and also slide up and down to accommodate changes in length due to temperature fluctuations. Embodiments may selectively anchor the seal stem only when the activation module shoulders on the top of the TBR. The seal stem may float inside the TBR otherwise. The activation module is placed inside pockets of the housing and slip arms of the anchor are assembled in the housing. The body include lock ring threads which holds the lock lugs, the housing, and the anchor. Since the lock lugs mate with the lock ring threads on the body, there is no possibility of presetting the anchor while tripping downhole. The biasing member (C-spring) helps ensure the lock lugs are in contact with the lock rings, preventing preset until the activation module housing butts against the top of the TBR. Activation may occur when all of the push pins are actuated such as when the activation module housing butts against the TBR top. This pushes on the wedge on the lock ring pushing it away from the lock ring threads. With the lock lugs disengaged from the lock ring threads, axial movement of the housing can take place. The slips may move setting the anchor and transferring the load to the casing.

Once the activation module is activated and the housing moves axially to set the anchor, a helical spring is compressed and stores energy. While anchoring all the compressive load will be carried by the anchor slips and transferred to the casing, leaving no load on the TBR. The anchor cone shoulders against the shoulder ring which should be put in place with the help of lock wires or a false shoulder due to the large load which it may carry.

In the scenario in which the seal stem moves away from the TBR top, the stored energy in the compressed spring will be released, pushing the slips back and unsetting the hanger allowing the seal stem to move freely. The setting and unsetting process can happen multiple times throughout the life of the well.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims. The scope of the invention should be determined only by the language of the claims that follow. The term "comprising" within the claims is intended to mean "including at least" such that the recited listing of elements in a claim are an open group. The terms "a," "an" and other singular terms are intended to include the plural forms thereof unless specifically excluded. In the claims, means-plus-function clauses are intended to cover the structures described herein as performing the recited function and not only structural equivalents, but also equivalent structures. It is the express intention of the applicant not to invoke 35 U.S.C. § 112, paragraph 6 for any limitations of any of the claims herein, except for those in which the claim expressly uses the words "means for" together with an associated function.

What is claimed is:

1. A seal stem anchor assembly comprising:

a tubular portion, the tubular portion having body lock threads disposed about a portion of an exterior of the tubular portion; and an anchor assembly, the anchor assembly comprising:

an activation module disposed about the tubular portion and proximate the body lock threads;

a cone;

one or more anchor slips extending between the activation module and the cone; and a helical spring disposed between the activation module and the cone, the helical spring biased so as to push the activation module away from the cone, wherein the activation module comprises:

an activation module housing, the activation module housing having at least one slip receiving feature disposed in a first end and at least one housing cavity and associated opening disposed in a second end;

a lock lug disposed in the housing cavity;

a push pin disposed in the housing cavity and extending through the opening;

a biasing member disposed in the housing cavity so as to bias the lock lug towards the tubular portion.

2. The seal stem anchor assembly according to claim 1 wherein an end of the push pin engages a ramped surface of the lock lug such that depressing the push pin causes the lock lug to move away from the tubular portion.

3. The seal stem anchor assembly according to claim 1 wherein the lock lug comprises lock lug teeth.

4. The seal stem anchor assembly according to claim 3 wherein the lock lug teeth are configured so as to engage the body lock threads on the tubular portion when the lock lug is moved towards the tubular portion.

5. The seal stem anchor assembly according to claim 1 wherein the anchor slips engage a wellbore tubular when the activation module is axially moved along the seal stem anchor.

6. The seal stem anchor assembly according to claim 5 wherein the wellbore tubular is a casing.

* * * * *